United States Patent [19]

Corsaut, III et al.

[11] Patent Number: 4,664,348

[45] Date of Patent: May 12, 1987

[54] BAG HOLDER

[76] Inventors: Otho O. Corsaut, III, 2018 Cass Blvd., Berkley, Mich. 48072; Donald Timmons, 30257 Longfellow Heights, Madison Heights, Mich. 48071

[21] Appl. No.: 823,524

[22] Filed: Jan. 29, 1986

[51] Int. Cl.[4] ..... B65B 67/04

[52] U.S. Cl. ..... 248/99; 15/257.1

[58] Field of Search ..... 248/150, 99, 97, DIG. 7, 248/153, 95; 294/19.1; 150/51; 15/257.9, 257.1; 220/404; 53/390; 141/314, 391, 108; 383/33

[56] References Cited

U.S. PATENT DOCUMENTS

| | | | |
|---|---|---|---|
| 1,266,522 | 5/1918 | Oldham | 141/108 |
| 3,754,785 | 8/1973 | Anderson | 294/19.1 |
| 4,052,764 | 10/1977 | Groff | 248/99 X |
| 4,193,157 | 3/1980 | Large | 15/257.1 |
| 4,250,601 | 2/1981 | Ward | 248/300 X |
| 4,291,798 | 9/1981 | Transport | 206/45.24 |
| 4,457,483 | 7/1984 | Gagne | 248/97 |
| 4,458,932 | 7/1984 | Resch | 15/257.1 X |
| 4,572,380 | 2/1986 | Langwell | 211/57.1 |

*Primary Examiner*—J. Franklin Foss

*Attorney, Agent, or Firm*—Lloyd M. Forster

[57] ABSTRACT

Trash bag holder comprising flexible plastic strip with intermediate straight portion adapted for insertion within trash bag opening for alternative ground or floor engagement or wall hanging with a bag retained in open receiving condition.

13 Claims, 5 Drawing Figures

30°

BAG HOLDER

BACKGROUND OF THE INVENTION

In addition to conventional practice for holding plastic trash bags open by placing them in an open container with bag edge stretched over the lip numerous devices have been used or proposed for temporary insertion in the bag opening while it is being filled either while hanging from a supporting structure or lying on the ground or floor to accommodate leaf raking or sweeping of debris into the bag. U.S. Pat. No. 3,754,785 discloses a portable bag holder for detachably mounting a flexible garbage bag with means for clamping the bag opening edge and including an elongated lip for facilitating passage of materials through the bag opening. U.S. Pat. No. 4,159,139 discloses a spreading device which includes relatively rigid elongated members pivotally connected with projections to engage a bag opening. U.S. Pat. No. 4,193,157 discloses a bag spreader in the form of a relatively rigid plastic hoop temporarily and served into the open mouth of a flexible plastic trash bag which includes integral external spikes adapted to be driven into the ground through the bag. An incline or guide is disclosed to ease the raking of leaves into the bag a number of additional prior art devices are described in the Background of the Invention of such patent.

BRIEF DESCRIPTION OF THE PRESENT INVENTION

A simple straight flexible plastic strip has been developed for insertion in the mouth of a plastic trash bag with notches for engaging and holding the edge of the bag with a projecting central section formed at an angle to the main body to provide a stiff straight section with a lip for engaging the ground or floor to accommodate raking of leaves or sweeping of trash into the bag when laid on the ground. The straight section is provided with holes for wall hanging and alternative use of the bag retained in opened position without the need for a rigid container.

The flexible ends of the strip are of sufficient length and stiffness to hold the mouth of the conventional trash bag wide open and the main plastic strip together with the projecting lip are of sufficient width to maintain the bag opening upright when placed on the ground or floor while leaves or debris are swept in.

DETAILED DESCRIPTION OF THE PREFERRED EMBODIMENT

Figures 1, 2, 3, 4, 5:
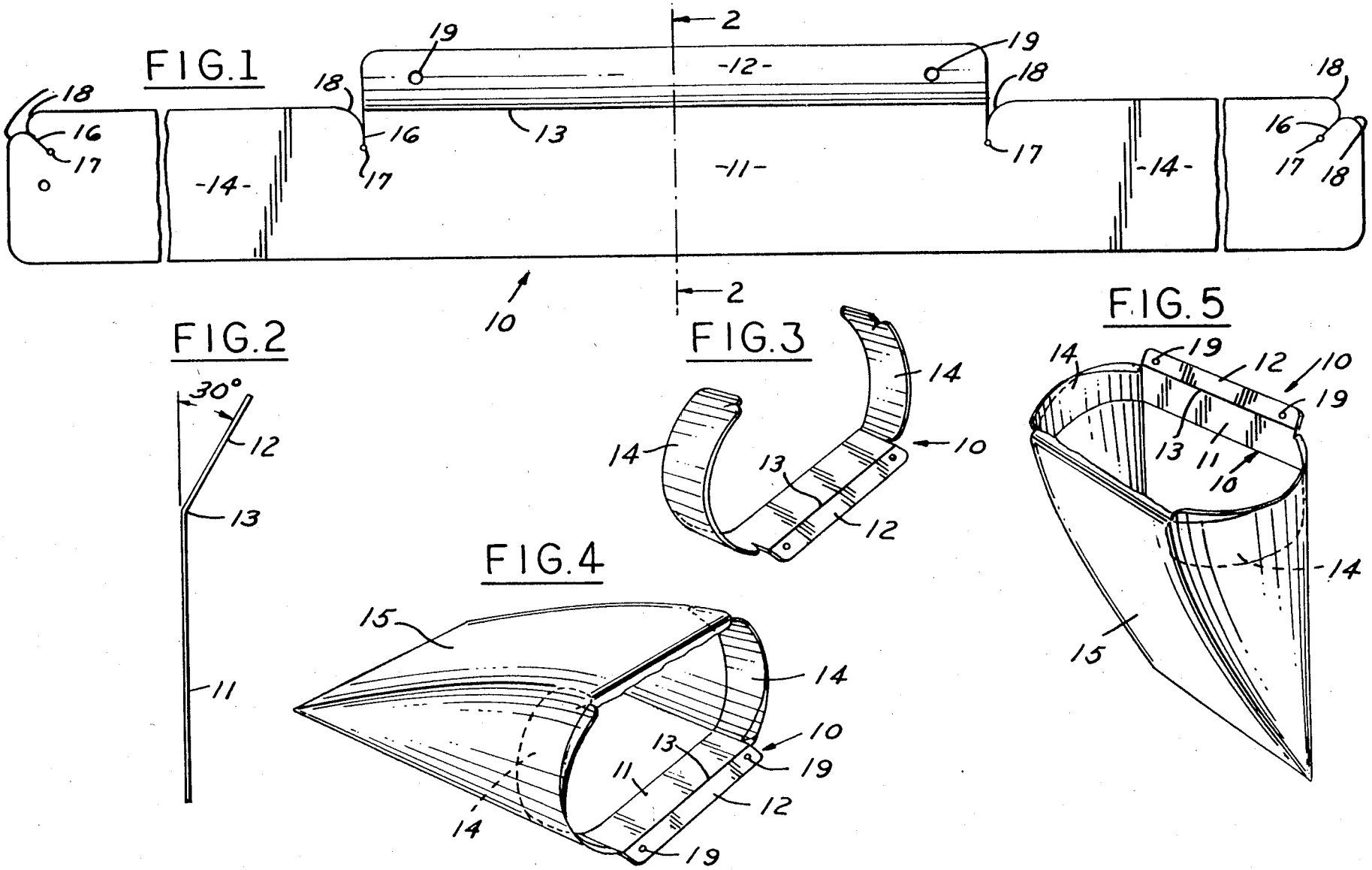
FIG. 1 is a plan view of a plastic strip in free state.
FIG. 2 is a sectional view taken along the line 2—2 of FIG. 1.
FIG. 3 is a perspective view of the plastic strip in its configuration for insertion within the bag opening.
FIG. 4 is a perspective view of the plastic strip in its operative position within the bag opening in its attitude for ground or floor engagement.
FIG. 5 is a perspective view illustrating the plastic strip and bag in its wall hanging attitude.

With reference to FIG. 1 plastic strip 10 comprises central section 11 having lip extension 12 formed at an angle 13, as best shown in FIG. 2, and with end extensions 14 provided an overall length appropriate for retaining a trash bag 15 in an open condition as illustrated in FIGS. 4 and 5.

Plurality of slits 16 are cut at intervals without removal of material except for small holes 17 pierced in blanking the strip to terminate any extension of slit opening beyond depth appropriate for retention of plastic trash bag edges inserted in the slits as shown in FIGS. 4 and 5. Rounded corners 18 are provided to facilitate trash bag edge insertion.

Retention provided by slits 16 at the four locations shown is adequate for retaining conventional plastic trash bag with normal trash loads when mounted in vertical position, as shown in FIG. 5, through use of hook holes 19, although mounting of the bag at floor support level for the bottom of the bag may be resorted to for heavy trash.

The angular bend of lip at 13 is permanently formed, as by wire heating, to provide a stiffness for central section 11 adequate to retain a straight line for flat ground or floor engagement in the attitude of FIG. 4 where leaves or trash may be raked or swept across the lip entrance without need for any manual or other retention of bag opening.

In a typical embodiment which has been found satisfactory for standard plastic trash bags, as well as oversize leaf bags, an overall length of 42" has been employed with 5½" maximum width, 1½" lip width, 13" end extension length, and with holes 17 located 3" from edge 20. Polyethylene plastic of 0.060" or 1/16" thickness with the foregoing indicated dimensions has been found to have suitable flexibility and strength to serve the required purpose and to retain the trash bag in either attitude of FIGS. 4 and 5 during filling without any additional manual or other support requirement.

We claim:

1. Bag holder comprising straight freestate flexible strip with intermediate integral projecting lip formed with an obtuse included angle to main body of flexible strip to maintain limited intermediate portion of its length in straight condition for flat ground or floor engagement of lip leading edge providing ramp guide for swept material while ends are flexed within bag opening, said strip having means including sufficient width to stand on horizontal support surface with trash bag opening erect.

2. Bag holder of claim 1 including slits extending inwardly from one longitudinal edge of said flexible strip for insertion and retention of bag opening edge.

3. Bag holder of claim 2 wherein said slits are provided at least at the ends of said intermediate portion.

4. Bag holder of claim 2 wherein said slits are provided at least at the ends of said intermediate portion and at the ends of said flexible strip.

5. Bag holder of claim 2 including curved entrances to said slits facilitating bag opening edge insertion.

6. Bag holder of claim 2 including holes at the internal terminal ends of said slits.

7. Bag holder of claim 1 including holes in said lip extension to accommodate wall hanging of holder with bag in open receiving position.

8. Bag holder of claim 1 wherein said flexible strip comprises plastic material.

9. Bag holder of claim 1 wherein said flexible strip comprises plastic material of approximately 1/16" thickness.

10. Bag holder of claim 9 wherein said flexible strip comprises a plastic material of approximately 42" length.

11. Bag holder of claim 10 wherein said flexible strip comprises a plastic material of approximately 5½" maximum width.

12. Bag holder of claim 11 wherein said flexible strip comprises a plastic material of approximately 4" flexible end extension width.

13. Bag holder of claim 1 wherein said lip end is formed at a approximately 30° angle to the main body of said flexible strip.

* * * * *